United States Patent [19]

Brazzoli

[11] Patent Number: 5,007,255

[45] Date of Patent: Apr. 16, 1991

[54] AUTOMATIC LOADING AND UNLOADING SYSTEM FOR DYEING MACHINES USING WOUND-UP FABRIC AND RELATIVE DEVICE FOR ITS ACCOMPLISHMENT

[75] Inventor: Giampietro Brazzoli, Milan, Italy

[73] Assignee: Brazzoli S.p.A., Italy

[21] Appl. No.: 442,023

[22] Filed: Nov. 27, 1989

[30] Foreign Application Priority Data

Nov. 29, 1988 [IT] Italy ..... 22785 A/88

[51] Int. Cl.[5] ..... D06F 23/16

[52] U.S. Cl. ..... 68/210

[58] Field of Search ..... 68/210, 177, 178, 181 R

[56] References Cited

U.S. PATENT DOCUMENTS

| | | | |
|---|---|---|---|
| 3,134,203 | 5/1964 | Roberts | 68/210 |
| 3,416,437 | 12/1968 | Drace et al. | 68/210 |
| 3,596,481 | 8/1971 | Wilcox | 68/210 |
| 4,467,530 | 8/1984 | Fesmire et al. | 68/210 |

*Primary Examiner*—Frankie L. Stinson

*Attorney, Agent, or Firm*—Shlesinger, Fitzsimmons & Shlesinger

[57] ABSTRACT

The present invention refers to a system wanting to accelerate dyeing time mechanizing the loading and unloading procedure of dyeing machines and consists in folding-up the fabric to be dyed outside the machine using a device capable of folding the fabric in a perforated vat reproducing both the size and shape of the kier of the dyeing machine, that is the part of the machine containing the fabric during dyeing time, and introducing the vat loaded with the fabric into the machine where the dyeing is carried out, the latter being equipped with a water-tight introduction door having previously joined the fabric to be dyed to the pass; in drawing out said vat from the machine after the dyeing procedure substituting it with a second vat containing other fabric to be dyed already folded-up.

Already known in the field of dyeing fabric rolled up into a cord, are dyeing kiers applying the so-called overflow method which foresees, generally parallel to the kier, a conduit through which the fabric passes wound up into a cord, said fabric is then pulled to the mouthpiece of said conduit being funnel-shaped at its tip by a pulling reel and along the conduit with the help of the dye-bath poured into said funnel and flowing in said conduit.

7 Claims, 9 Drawing Sheets

AUTOMATIC LOADING AND UNLOADING SYSTEM FOR DYEING MACHINES USING WOUND-UP FABRIC AND RELATIVE DEVICE FOR ITS ACCOMPLISHMENT

Already known, through Italian Pat. No. 1.167.144 belonging to Luciano Aschieri, is a dyeing machine having a movable pulling device to convey the fabric including: a kier containing the treatment bath for the fabric and a conveying device for said fabric working with a to and fro motion going upwards and crosswise the kier so as to keep folding the fabric in the dyebath in both directions.

Further, we know that a certain length of time is spent for the loading of the fabric to be dyed in the kier and consequently of the unloading of the fabric after dyeing.

This time weighs upon the general dyeing time cycle employing for the loading and unloading operation a time equal too 35%-50% of the time actually needed for the dyeing. This fact also weighs upon operation costs having to keep a machine working for an unproductive operation when an investment has been made paying between 35%-50% more than strictly necessary for just the dyeing procedure.

It is the object of the present invention to present a system which by a modest cost will overcome the above mentioned inconveniences.

The invention consists in folding up the fabric to be dyed outside the dyeing machine with a device capable of folding the fabric in a perforated vat similar in both the size and shape of the kier of the dyeing machine that is, the part of the machine containing the fabric during dyeing and introducing the vat loaded with the folded fabric into the machine having a watertight introduction door; of drawing out said vat from the machine after dyeing substituting it with a second vat containing other folded fabric to be dyed.

With this system, the time in which the machine is not operating is reduced to just the time necessary to introduce the vat containing the fabric in the dyeing machine, to join the fabric to be dyed to the pass and to close the door, and vice-versa after dyeing, the opening of the door, detatching the dyed fabric from the pass and drawing out the vat from the machine.

Figure 1:
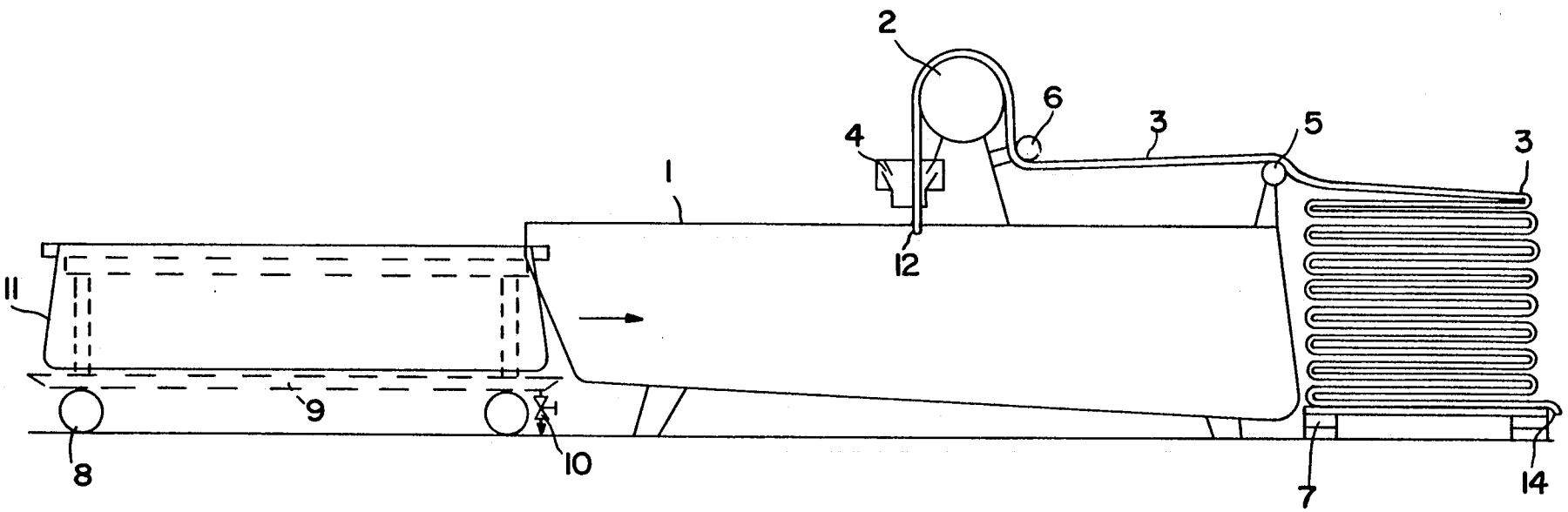

The invention will be better understood from the description of the emboviment given as two non limiting exemples of the device carrying out the prefolding procedure in the perforated vat. The first is the application of the finding and the relative functioning of a dyeing machine having a mobile pulling device for the fabric and the second, of a dyeing machine of the overflow type both illustrated by the enclosed drawings in longitudinal section in which:

FIG. 1—The pre-folding device for the fabric during the introduction phase of the vat.

Figure 2:
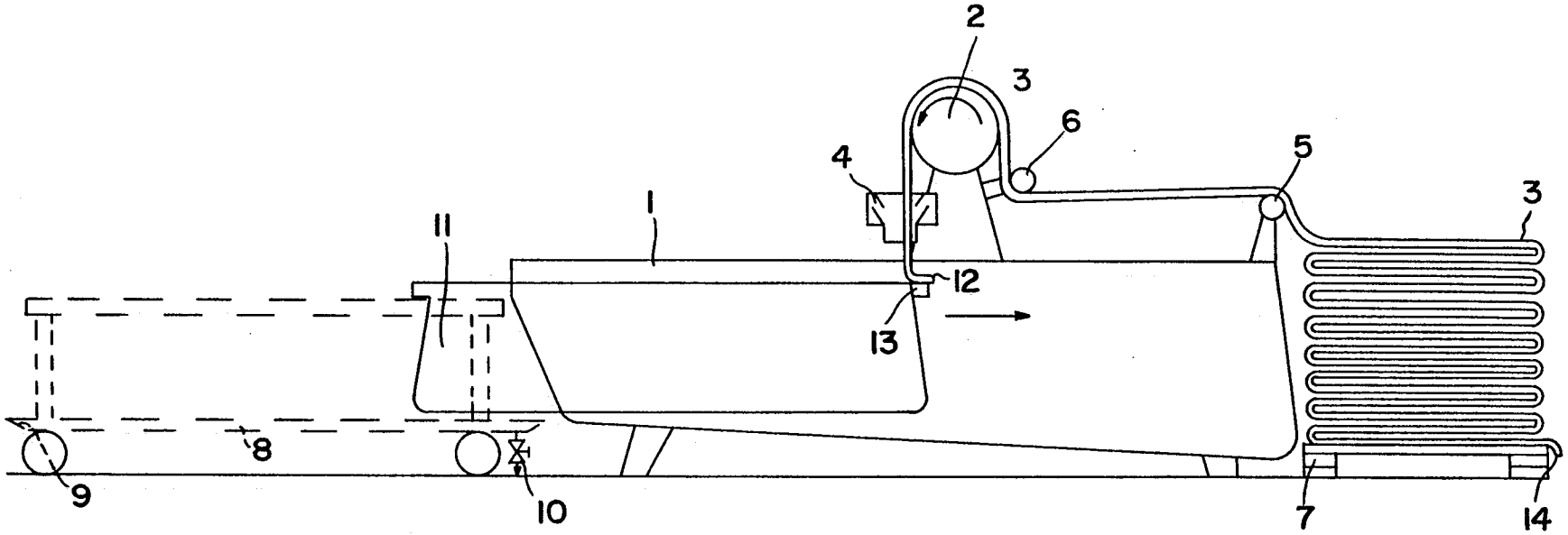
Figure 3:
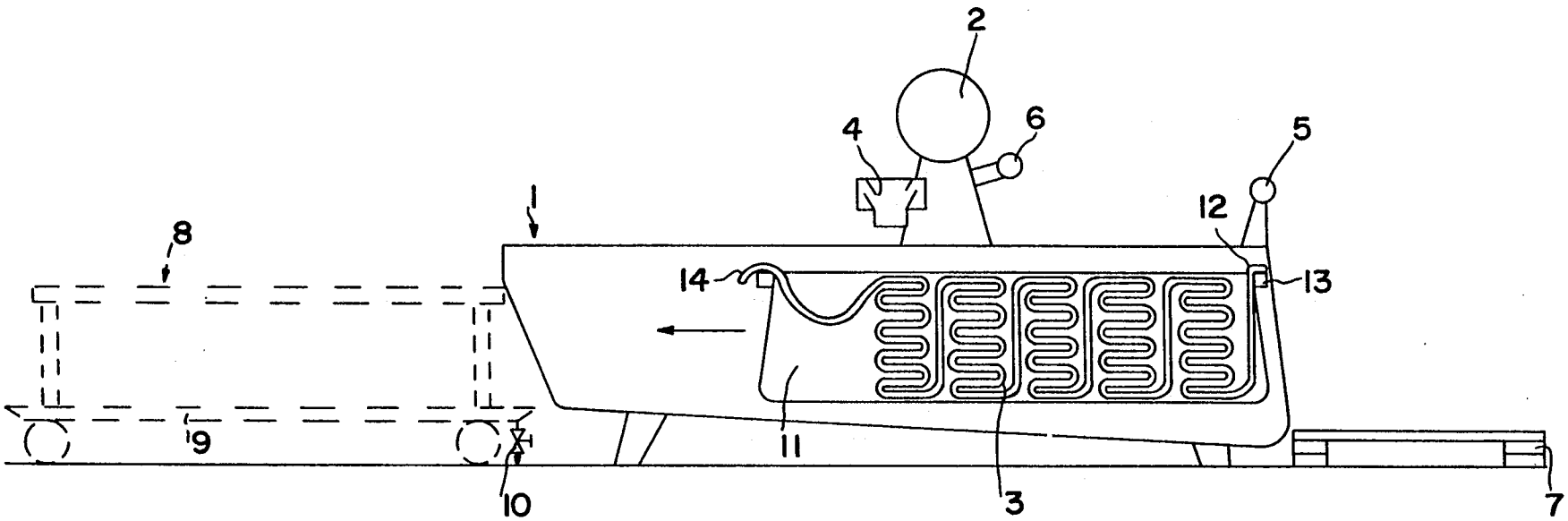

FIG. 2—The pre-folding device at the beginning stage of the operation. FIG. 3—The pre-folding device at the end stage of the operation.

Figure 4:
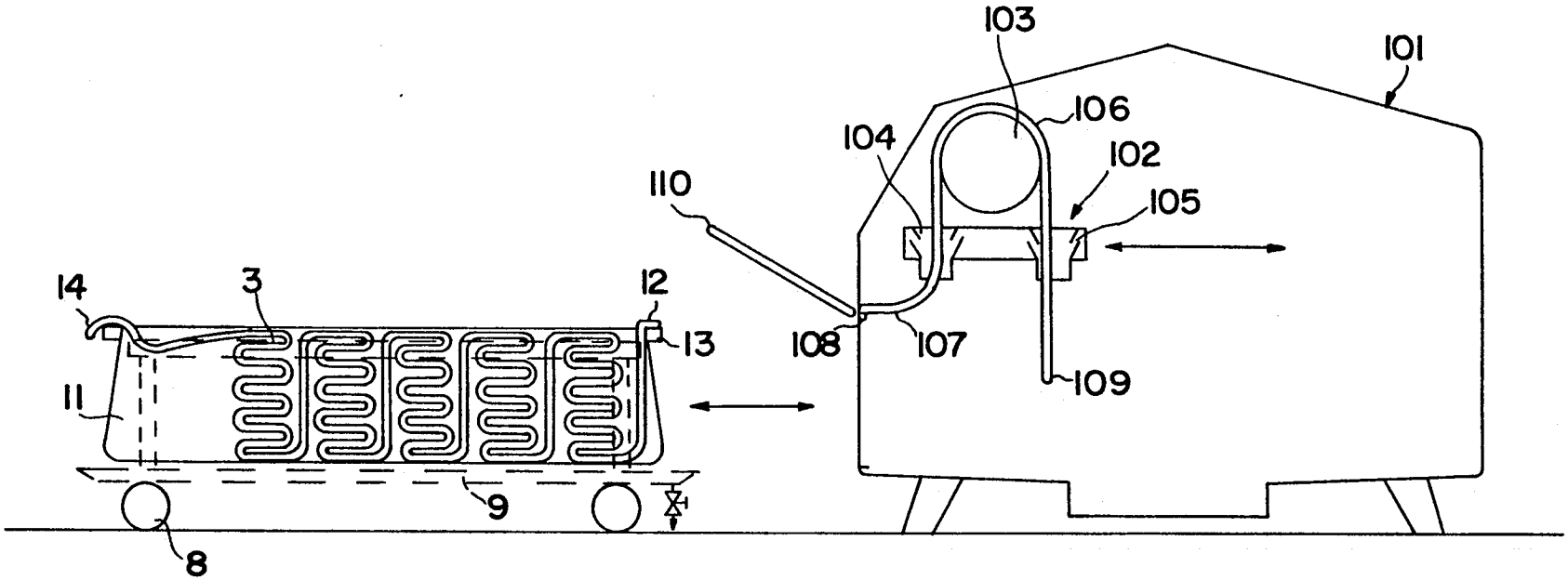

FIG. 4—A dyeing machine having a mobile pulling device for the fabric during the loading stage of the vat containing the folded fabric.

Figure 5:
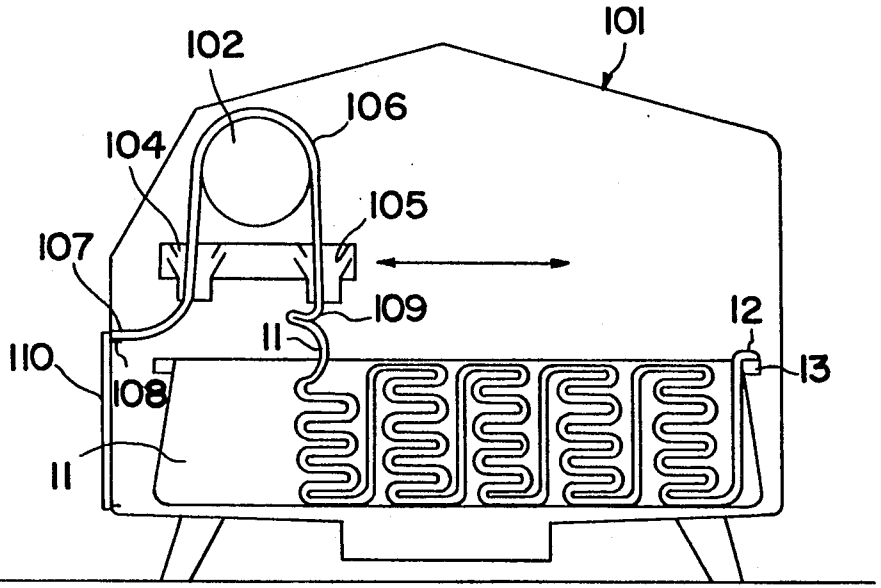
Figure 6:
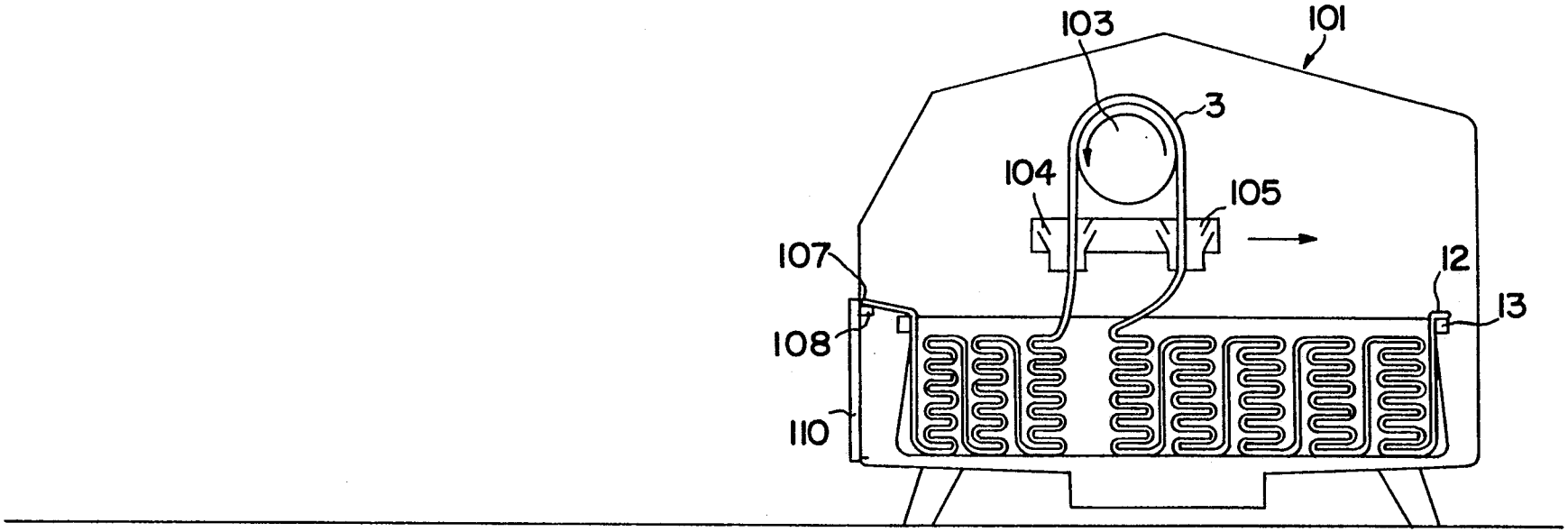

FIG. 5—Machine as above showing the fabric passed and joined to the fabric to be dyed with the door closed at the beginning of the functioning cycle:

FIG. 6—Machine as above when functioning.

Figure 7:
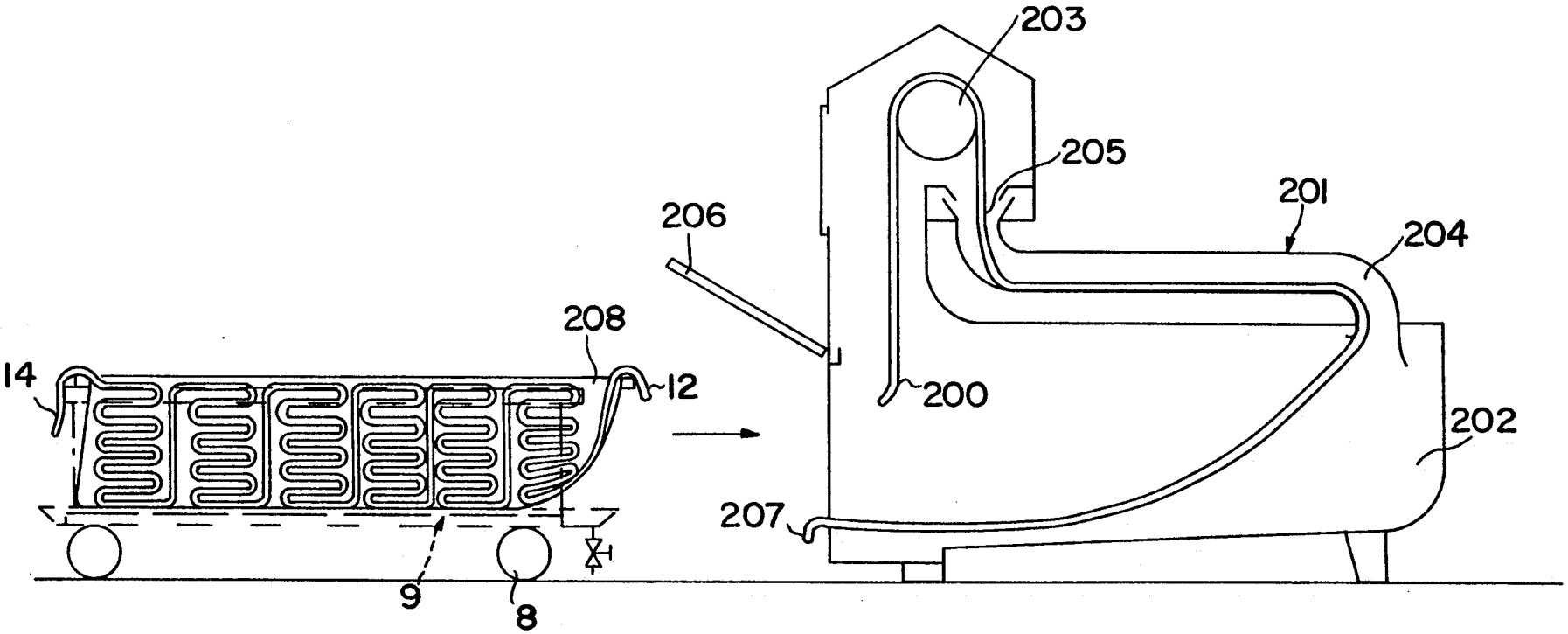

FIG. 7—An overflow-type machine during loading stage of the fabric.

Figure 8:
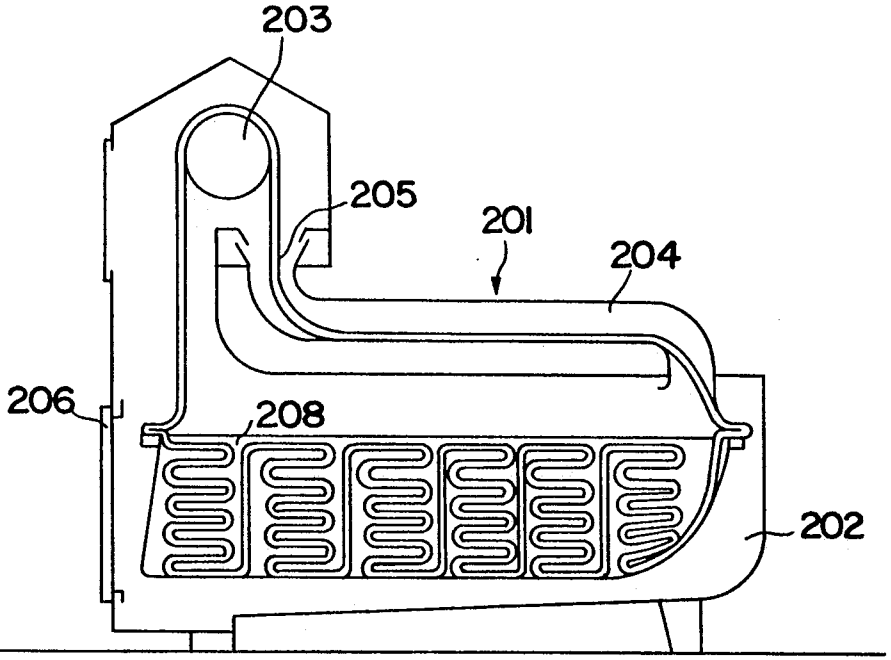

FIG. 8—A machine as above showing the fabric joined to the passed fabric at the beginning stage of functioning.

Figure 9:
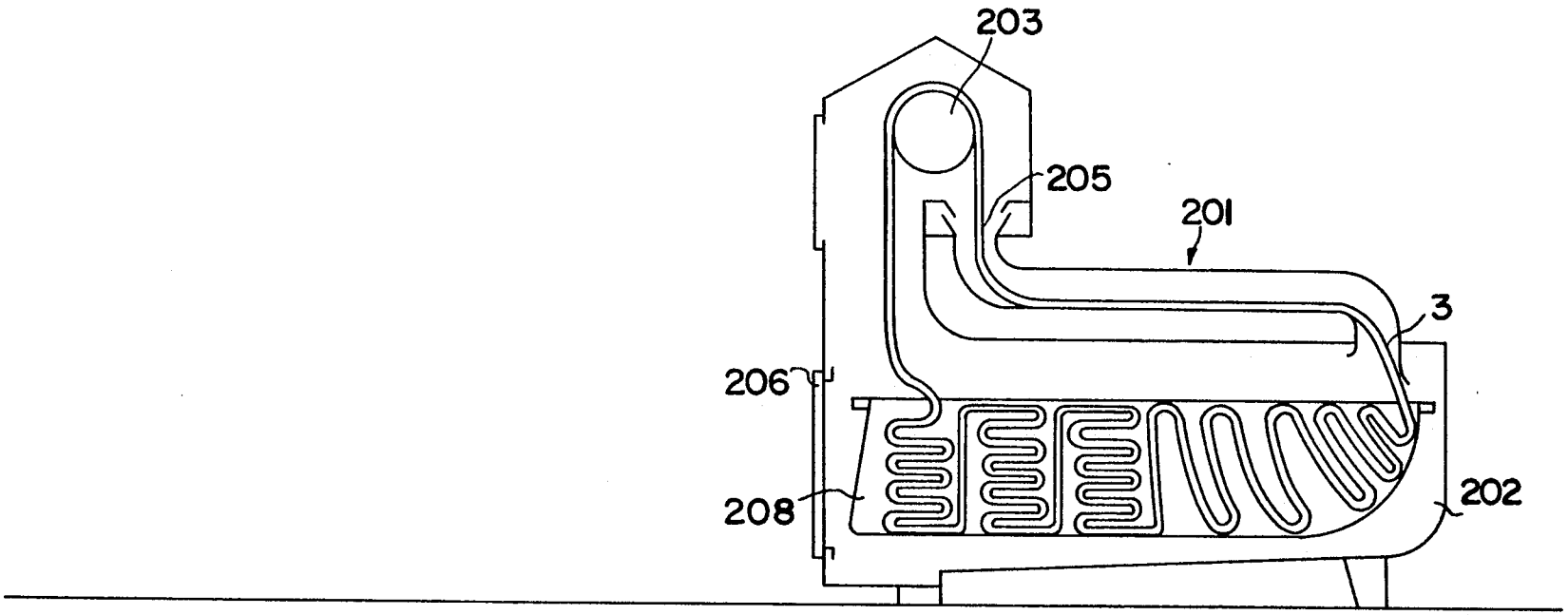

FIG. 9—An overflow-type machine at an intermediate stage of the first functioning cycle.

With reference to FIGS. 1, 2 and 3, the prefolding device according to the invention is made up of a framework 1 which is substantially tub shaped over which is situated a motorized reel 2. Beneath reel 2 along the side thereof where the fabric 3 drops into the vat, is arranged a funnel-shaped guide 4.

On the end of the framework 1 on the side receiving the fabric 3 and again at the point just before the reel 2, are situated two guiding rollers for the fabric 5 and 6.

On the side of the framework 1 where the guiding roller 5 is situated, is placed the fabric which is to be prefolded: in the drawing it is shown placed on a stand 7, but it can also be rolled up and be drawn directly from the rolls, by placing the roll of fabric on a spindle which can be simple or motorized according to the need or the type and weight of the fabric to be unrolled.

On the carriage 8 having the shape of a basin 9 to collect the water dropping from the vat during transport and provided with a safety valve 10, is arranged a perforated vat 11 of about the same shape as the kier of the dyeing machine to which it is directed.

Underneath the framework, are arranged driving means for the vat of the known type as for example motorized rollers a surface or a framework movable along the axis of framework 1, by means of pistons etc. so as to move the vat step by step under the folding device with known means during operation.

The carriage 8 is also in turn provided with known means to facilitate sliding of the vat 11, so that the transfer operation of vat 11 from carriage 8 to the prefolding device and from the latter to the carriage 8 and successively from the carriage to the dyeing machine and from here again to the carriage can occur easily with a simple push.

FIGS. 2 and 3 illustrate the folding operation.

The vat 11 is moved by carriage 8 to the prefolding device 1 and the fabric 3 is passed on the rollers 5 and 6 on the reel 2 and into the funnel 4 and its front end 12 is fixed at 13 to an end of the vat 11. Water is introduced in funnel 4 with known means so as to wet the fabric so that it can be easily heaped up and as much as possible introduced into the vat which, if dry would take up much more space as shown in FIG. 2.

The reel, pulling the fabric 3 from the stand 7, is turned on making the wet fabric fall into the vast 11 where it folds up.

When the first pile of folded fabric finishes, the vat 11 is urged forward a step and so on until the vat fills up as shown in FIG. 3. The vat full of fabric to be dyed is shifted to carriage 8 to be taken to the dyeing machine.

With reference to FIGS. 4, 5 and 6 we have a dyeing machine 101 of the type supplied with a mobile fabric conveying device 102 made up essentially of a roll 103 and two funnells 104 and 105, through which flows the dye-bath, heated by convenient means and conduced by means of pumps, not indicated in the drawings as they refer to the functioning of the machine and therefore not part of the finding.

The device 102 operates by the means indicated in Italian Pat. No. 1.167.144 so as to move alternatively along the kier in a to and fro motion.

On the reel 103 and passing through the two funnel 104 and 105, is arranged a short leader section of fabric or a pass 106 having one end 107 fixed at 108 on the machine 1 and the other end 109 free.

In a perforated vat 11 placed on a carriage 8, is disposed the fabric 3 to be dyed already folded beforehand in the vat in the device already described and illustrated in FIGS. 1, 2 and 3 of the present finding.

Of the two ends of the fabric, one 12 is fixed to the vat at 13 and the other 14, is free.

The machine 101 is supplied with a water tight door 110 for the introduction of the vat into the kier.

The function is as follows:

Carriage 8 is drawn near the kier, the free end 14 of the fabric to be dyed is joined to the free end 109 of the pass, vat 11 holding the fabric to be dyed 3 pushed into the machine, the door 110 is closed as shown in FIG. 5 and therefore the machine is ready to carry out the dyeing operation as shown in FIG. 6.

Viceversa, when the dyeing cycle has finished, it is sufficient to just open the door 110, detach the end 109 of the pass from the end 14 of the dyed fabric, draw out the vat 11 holding the dyed fabric depositing it onto the carriage 8 and substituting it with another vat with other fabric to be dyed ready for the next dyeing cycle.

With reference to FIGS. 7, 8 and 9, we illustrate the system of the present finding applied to another type of dyeing machine, that is, to a dyeing machine of the overflow type. For this type of the machine 201 we also present it schematized as comprising thereunder a kier 202 to contain the dye-bath for the fabric and above it, a pulling reel 203 and an overflow conduit 204. This kier is also equipped with an opening at its side with a water tight opening door 206.

On the reel 203 and in the overflow conduit 204, is situated the pass 205 having both ends 200 and 207 free.

In a perforated vat 208 having the shape of the bottom of the kier of an overflow machine and disposed on a carriage 8, is placed the fabric 3 folded beforehand by the same device described and illustrated in FIGS. 1, 2 and 3, in this case however, the two ends 14 and 12 of the fabric 3 must both be free.

The proceedings for its functioning is as follows:

The door 206 is opened, carriage 8 is drawn to the machine and end 207 of the pass is connected to end 12 of the fabric; the perforated vat 208 is pushed into the kier 202 and end 14 of the fabric is connected to end 200 of the pass; the door 206 in FIG. 8 is closed and the machine can begin to operate and the folded fabric folded vertically in the folding device is arranged, after the first cycle, folded horizontally which is the usual position of the fabric in this kind of machine (FIG. 9).

When the dyeing operation has finished the door 206 is opened, the ends 200 and 207 of the pass are detatched from the ends 12 and 14 of the fabric, the vat 208 is drawn out and settled on a carriage 8 to be taken to the drier and substituted with another containing more fabric to be dyed.

Infact, with the application of the finding on dyeing machines, the unproductive period of the loading and unloading process is greatly reduced, increasing potential in practice from 30%–50% while so, a simple folding device, relatively low in price respect to that of a dyeing machine and folding at a higher speed than in a dyeing machine, is capable of serving more than one dyeing machine for the preparation of folded fabric in the vats.

I claim:

1. Automatic loading and unloading device for a dyeing machine of the type having a kier for receiving fabric folded up into cords, characterized by the fact that, the fabric to be dyed is folded outside the dyeing machine kier, and comprising a perforated vat similar in form and dimension to the kier of the dyeing machine, means at the exterior of said machine for folding into said vat the fabric which is to be dyed, said folded fabric being disposed to be introduced with the vat into said machine where it undergoes a dyeing operation, said machine having thereon a water tight introduction door through which said vat passes in and out of said machine, and the dyed fabric being disposed to be drawn out in the vat from the machine after the dyeing procedure, and to be immediately substituted with another amount of fabric to be dyed prefolded in another vat.

2. A dyeing machine of the type characterized by claim 1, wherein said water tight introduction door is movably mounted on one side of said dyeing machine to allow the introduction of the perforated vat into said kier before the beginning of the dyeing operation, and the subsequent extraction of the same perforated vat containing the dyed fabric.

3. Automatic loading and unloading device according to claim 1 characterized by the fact that said dyeing machine includes a movable fabric transfer device mounted to glide in a to and fro motion above and along the kier, and having thereon a short leader section of fabric, one of the ends of the folded fabric in said vat being fixed to said vat, and one of the ends of said leader section of fabric being fixed to said machine adjacent said introduction door, while the other ends of the folded fabric and of the leader section, once the vat is introduced into the machine, are joined to each other and vice-versa are detached from each other when the vat containing the dyed fabric is thereafter drawn out of the machine.

4. Device according to claim 3 characterized by the fact that, in the case of a dyeing machine of the overflow type, both ends of the pass and the two ends of the folded fabric are free and are joined to each other, respectively, before the introduction of the vat into the machine and vice-versa separated when the vat is drawn out from the machine with the dyed fabric.

5. Prefolding device for fabric which is to be dyed in a dying machine, comprising a frame open at one end and slightly tilted at its other end, a motorized reel mounted on said frame and having a rolling guide on one side thereof and on its opposite side a guiding funnel, said reel being operable to draw folded fabric from a supply thereof letting said fabric fall through said funnel into a perforated vat so that the fabric can fold up in said vat vertically.

6. Device according to claim 5 characterized by the fact that, said vat is mounted for translational step by step movement under said funnel in synchronism with the formation therein of the successive folds on the folded fabric.

7. Device according to claim 5 characterized by the fact that, in said funnel is introduced water so as to wet the fabric to permit a better compact formation of the same in the vat.

* * * * *